US009528081B2

(12) United States Patent
Tantawy et al.

(10) Patent No.: US 9,528,081 B2
(45) **Date of Patent: *Dec. 27, 2016**

(54) METHOD OF MAKING GRANULAR DETERGENT COMPOSITIONS COMPRISING POLYMERS

(71) Applicant: The Procter & Gamble Company, Cincinnati, OH (US)

(72) Inventors: Hossam Hassan Tantawy, Northumberland (GB); Sabrina Beatrice Danielle Gault, Newcastle upon Tyne (GB); Andrew Brian Greenaway Patton, Durham (GB); Adam Porter, Tyne and Wear (GB); Stephen John Walker, Northumberland (GB); Hossein Ahmadian, Newcastle upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 43 days.

This patent is subject to a terminal disclaimer.

(21) Appl. No.: 14/446,579

(22) Filed: Jul. 30, 2014

(65) Prior Publication Data

US 2015/0038397 A1 Feb. 5, 2015

(30) Foreign Application Priority Data

Jul. 30, 2013 (EP) ..... 13178594

(51) Int. Cl.

| | |
|---|---|
| ***C11D 11/02*** | (2006.01) |
| ***C11D 3/37*** | (2006.01) |
| ***C11D 3/42*** | (2006.01) |
| ***C11D 17/06*** | (2006.01) |
| ***C11D 17/00*** | (2006.01) |

(52) U.S. Cl.

CPC ..... *C11D 17/0017* (2013.01); *C11D 3/3788* (2013.01); *C11D 11/02* (2013.01); *C11D 17/0026* (2013.01)

(58) Field of Classification Search

None

See application file for complete search history.

(56) References Cited

U.S. PATENT DOCUMENTS

| | | | | |
|---|---|---|---|---|
| 4,020,015 | A * | 4/1977 | Bevan | C11D 3/0036 510/299 |
| 4,136,045 | A * | 1/1979 | Gault | C11D 1/44 510/224 |
| 4,421,657 | A * | 12/1983 | Allen | C11D 3/001 252/383 |
| 4,746,456 | A | 5/1988 | Kud et al. | |
| 4,846,994 | A | 7/1989 | Kud et al. | |
| 4,904,408 | A | 2/1990 | Kud et al. | |
| 5,049,302 | A | 9/1991 | Holland et al. | |
| 5,635,554 | A | 6/1997 | Boeckh et al. | |
| 5,733,856 | A | 3/1998 | Gopalkrishnan et al. | |
| 7,163,985 | B2 | 1/2007 | Ortiz et al. | |
| 7,465,701 | B2 | 12/2008 | Sharma et al. | |
| 8,334,250 | B2 | 12/2012 | Murkundc et al. | |
| 2003/0224025 | A1 | 12/2003 | Gotsche et al. | |
| 2004/0063598 | A1 | 4/2004 | Riebe et al. | |
| 2004/0121934 | A1 | 6/2004 | Dougherty | |
| 2006/0270582 | A1 | 11/2006 | Boeckh et al. | |
| 2008/0300158 | A1 | 12/2008 | Schutz et al. | |
| 2009/0005287 | A1 | 1/2009 | Boutique et al. | |
| 2009/0005288 | A1 | 1/2009 | Boutique et al. | |
| 2009/0023625 | A1 | 1/2009 | Tang et al. | |
| 2009/0176935 | A1 | 7/2009 | Boeckh et al. | |
| 2009/0258983 | A1 * | 10/2009 | Fernandez | C11D 1/8255 524/377 |
| 2009/0291875 | A1 | 11/2009 | Lant et al. | |
| 2009/0298735 | A1 | 12/2009 | Boeckh et al. | |
| 2011/0152160 | A1 | 6/2011 | Murkundc et al. | |
| 2015/0038394 | A1 | 2/2015 | Tantawy et al. | |
| 2015/0038396 | A1 | 2/2015 | Tantawy et al. | |

FOREIGN PATENT DOCUMENTS

| | | |
|---|---|---|
| EP | 0358474 A2 | 3/1990 |
| GB | 2304726 A | 3/1997 |

OTHER PUBLICATIONS

Extended European Search Report, Application No. 13178588.3-1358, dated Jun. 10, 2014, 8 pages.
Extended European Search Report, Application No. 13178591.7-1358, dated Jun. 10, 2014, 8 pages.
Extended European Search Report, Application No. 13178594.1-1358, dated Jun. 10, 2014, 8 pages.
Extended European Search Report, Application No. 13178595.8-1358, dated Jun. 10, 2014, 8 pages.
U.S. Appl. No. 14/446,565, filed Jul. 30, 2014, Tantawy, et al.
U.S. Appl. No. 14/446,575, filed Jul. 30, 2014, Tantawy, et al.
U.S. Appl. No. 14/446,587, filed Jul. 30, 2014, Tantawy, et al.

* cited by examiner

*Primary Examiner* — Lorna Douyon

(74) *Attorney, Agent, or Firm* — John T. Dipre; Steven W. Miller

(57) ABSTRACT

A process of making a granular detergent composition comprising the steps of:

a) forming an aqueous detergent slurry;
b) spray drying the aqueous detergent slurry to form a plurality of spray-dried detergent particles;
c) forming an emulsion comprising a polymer; and
d) adding the emulsion from step c) to at least a portion of the plurality of spray-dried detergent particles.

12 Claims, No Drawings

METHOD OF MAKING GRANULAR DETERGENT COMPOSITIONS COMPRISING POLYMERS

FIELD OF THE INVENTION

The present invention is directed to methods of making granular detergent compositions containing polymers.

BACKGROUND OF THE INVENTION

Polymers are often added to laundry detergent compositions. The polymers can provide benefits such as soil release, anti-redeposition, dye transfer inhibition etc.

Often, polymers are available in a liquid form. In the case of granular laundry detergent compositions they are often added at the end of the manufacture process, in which they are sprayed onto the detergent granules. However, this post addition spray-on results in the formation of large granules, due to uneven distribution of the polymer, i.e. the polymer tends to form large droplets that stick to the detergent granules and result in the formation of large granules.

The formation of these large granules is undesirable to consumers, who prefer smaller granules. Consumers associate large granules with slow dissolution and poor cleaning performance.

Thus, there is a need in the art for a method to make a granular detergent composition that comprises polymers and that has a consumer acceptable appearance.

The Inventors have surprisingly found that if an emulsion is firstly made of the polymer ahead of spraying onto the spray-dried particles, the problem of large granule formation is reduced.

SUMMARY OF THE INVENTION

One aspect of the present invention is a process of making a granular detergent composition comprising the steps of:

a) forming an aqueous detergent slurry;
b) spray drying said aqueous detergent slurry to form a plurality of spray-dried detergent particles;
c) forming an emulsion comprising a polymer; and
d) adding the emulsion from step c) to at least a portion of said plurality of spray-dried detergent particles.

DETAILED DESCRIPTION OF THE INVENTION

As used herein, "consisting essentially of" means that the composition or component may include additional ingredients, but only if the additional ingredients do not materially alter the basic and novel characteristics of the claimed compositions or methods.

All percentages, parts and ratios are based upon the total weight of the composition of the present invention and all measurements made are at 25° C., unless otherwise specified. All such weights as they pertain to listed ingredients are based on the active level and therefore do not include carriers or by-products that may be included in commercially available materials, unless otherwise specified.

Granular laundry detergents may be manufactured using a spray drying process. The spray drying process typically includes spraying an aqueous slurry comprising detergent ingredients into a spray-drying tower through which hot air flows. As it falls through the tower, the aqueous slurry forms droplets, the hot air causes water to evaporate from the droplets, and a plurality of spray-dried granules is formed.

The resulting granules may form the finished granular detergent composition. Alternatively, the resulting granules may be further processed (such as via agglomeration) and/or further components (such as detergent adjuncts) may be added thereto.

Process of Making

The present invention is to a process of making a granular detergent composition comprising the steps of:

a) forming an aqueous detergent slurry;
b) spray drying said aqueous detergent slurry to form a plurality of spray-dried detergent particles;
c) forming an emulsion comprising a polymer; and
d) adding the emulsion from step c) to at least a portion of said plurality of spray-dried detergent particles.

The process can be batch, continuous, or semi-continuous.

Step a): an aqueous slurry is prepared using any suitable method. For example, the aqueous slurry may be prepared by mixing detergent ingredients together in a crutcher mixer. The aqueous slurry preferably comprises detersive surfactant, alkalinity source, at least one additional detergent ingredient or a combination thereof. The aqueous slurry may contain water at a weight percentage of from about 25 wt % to about 50 wt %.

The aqueous slurry can comprise from above 0 wt % to about 30 wt % detersive surfactant, preferably from about 10 wt % to about 20 wt % detersive surfactant.

Useful amounts of an alkalinity source can include from about 1 to about 20% or from about 1 to about 10% of alkalinity source by weight of the composition.

The detersive surfactant, alkalinity source and at least one additional detergent ingredient are described in more detail below.

Step b): the aqueous slurry is spray dried using standard techniques. The aqueous slurry is transferred from the mixer preferably through at least a first pump and a second pump to a spray nozzle. Typically, the aqueous slurry is transferred in a pipe. The aqueous slurry is typically transferred through an intermediate storage vessel such as a drop tank, for example when the process is semi-continuous. Alternatively, the process can be a continuous process, in which case no intermediate storage vessel is required. Typically, when two or more pumps are used, the first pump is a low pressure pump, such as a pump that is capable of generating a pressure of from $3\times10^5$ to $1\times10^6$ Pa, and the second pump is a high pressure pump, such as a pump that is capable of generating a pressure of from $2\times10^6$ to $1\times10^7$ Pa. Optionally, the aqueous slurry is transferred through a disintegrator, such as disintegrators supplied by Hosakawa Micron. The disintegrator can be positioned before the pump, or after the pump. If two or more pumps are present, then the disintegrator can also be positioned between the pumps. Typically, the pumps, disintegrators, intermediate storage vessels, if present, are all in series configuration. However, some equipment may be in a parallel configuration. A suitable spray nozzle is a Spray Systems T4 Nozzle. Gas may be injected into the aqueous slurry at any point after the crutcher mixer and prior to being spray-dried. Further detergent ingredients may also be injected into the aqueous slurry after the crutcher mixer and prior to being spray-dried. For example an liquid anionic surfactant mix may be added to the aqueous slurry after the crutcher mixer and prior to being spray-dried.

The aqueous slurry is sprayed through the spray nozzle into a spray-drying tower. Preferably, the mixture is at a temperature of from 60° C. to 140° C. when it is sprayed through the spray nozzle into a spray-drying tower. Suitable spray-drying towers are co-current or counter-current spray-drying towers. The mixture is typically sprayed at a pressure of from $6\times10^6$ Pa to $1\times10^7$ Pa. The slurry is spray-dried to form a spray-dried powder. Preferably, the exhaust air temperature is in the range of from 60° C. to 100° C.

Step c): an emulsion comprising a polymer, preferably, wherein the discrete phase comprises the polymer is prepared. Suitable polymers are described in more detail below. The continuous phase can be any suitable material, for example a solvent. Preferably, the continuous phase is a surfactant. The surfactant in the emulsion can be any surfactant, for example, non-ionic, cationic, anionic, zwitterionic or a combination thereof. Preferably, the surfactant in the emulsion is a non-ionic surfactant. The emulsion can be prepared via any suitable method, using any suitable equipment. A preferred method for preparing the emulsion comprises the steps;

i. forming a first liquid, optionally comprising a surfactant;
ii. forming a second liquid comprising a polymer;
iii. passing the first and second liquids through a mixer;
iv. mixing the first and second liquids to form the emulsion.

Any suitable mixing device can be used. A preferred mixing device is a high shear mixer. Suitable high shear mixers can be dynamic or static mixers. A suitable dynamic mixer can be a rotor-stator mixer. The emulsion making process can be a batch or continuous process. The polymer may be at a temperature of between 55 and 65° C. as it is added to the mixer. The surfactant may be at a temperature of between 35 and 50° C. as it is added to the mixer. The temperature of the mixture in the mixer can be between 40 and 60° C.

The surfactant in the emulsion can be any surfactant, for example, non-ionic, cationic, anionic, zwitterionic or a combination thereof. Preferably, the surfactant in the emulsion is a non-ionic surfactant.

Step d): the emulsion from step c) is added to at least a portion of said plurality of spray-dried detergent particles. The spray-dried particles may be present in a rotary mix drum, or a batch drum or a belt conveyer. The emulsion may be transferred along a pipe to a suitable means for adding the emulsion to at least a portion of said plurality of spray-dried detergent particles. A suitable means of adding could be a spray nozzle. Preferably the emulsion is maintained at a temperature of between 30 and 60° C., preferably between 40 and 60° C. prior to addition to the spray-dried detergent particles. This temperature is preferred because at lower temperatures, the viscosity of the emulsion increases. At lower viscosities it is easier to spray the emulsion.

Without wishing to be bound by theory, it is believed that the dispersion of the polymer over the detergent granules is ineffective due to the high viscosity of the polymer material. Forming the polymer into an emulsion enables smaller granule size, as the polymer is more evenly distributed.

In one embodiment, an optical brightener may be added to the emulsion. The optical brightener may be added with the polymer prior to the formation of the emulsion, or alternatively, the optical brightener may be added to the emulsion once the emulsion is formed. Without wishing to be bound by theory, it was surprisingly found that the addition of the optical brightener to the emulsion provided improved whiteness perception of fabrics washed using detergent compositions made by the process of the present invention by consumers as opposed to fabrics washed with detergent compositions in which the optical brightener was added as a separate particle. Suitable optical brighteners are detailed below.

Detersive Surfactant

Any suitable detersive surfactant is of use in the aqueous slurry.

Suitable detersive surfactants include, but are not limited to: anionic surfactants, non-ionic surfactants, cationic surfactants, zwitterionic surfactants, amphoteric surfactants and any mixtures thereof. Preferred surfactants include anionic surfactants, cationic surfactants, non-ionic surfactants and any mixtures thereof.

Suitable anionic surfactants can include alkyl benzene sulphonate. Preferably the anionic detersive surfactant comprises at least 50 wt %, at least 55 wt %, at least 60 wt %, at least 65 wt %, at least 70 wt %, at least 75 wt %, at least 80 wt %, at least 85 wt %, at least 90 wt %, or even at least 95 wt %, by weight of the anionic detersive surfactant, of alkyl benzene sulphonate. The alkyl benzene sulphonate is preferably a linear or branched, substituted or unsubstituted, $C_{8-18}$ alkyl benzene sulphonate. This is the optimal level of the $C_{8-18}$ alkyl benzene sulphonate to provide a good cleaning performance. The $C_{8-18}$ alkyl benzene sulphonate can be a modified alkylbenzene sulphonate (MLAS) as described in more detail in WO 99/05243, WO 99/05242, WO 99/05244, WO 99/05082, WO 99/05084, WO 99/05241, WO 99/07656, WO 00/23549, and WO 00/23548. Highly preferred $C_{8-18}$ alkyl benzene sulphonates are linear $C_{10-13}$ alkylbenzene sulphonates. Especially preferred are linear $C_{10-13}$ alkylbenzene sulphonates that are obtainable by sulphonating commercially available linear alkyl benzenes (LAB); suitable LAB include low 2-phenyl LAB, such as those supplied by Sasol under the trade name Isochem® or those supplied by Petresa under the trade name Petrelab®. Other suitable LAB include high 2-phenyl LAB, such as those supplied by Sasol under the trade name Hyblene®.

The anionic detersive surfactant may preferably comprise other anionic detersive surfactants. A suitable anionic detersive surfactant is a non-alkoxylated anionic detersive surfactant. The non-alkoxylated anionic detersive surfactant can be an alkyl sulphate, an alkyl phosphate, an alkyl phosphonate, an alkyl carboxylate or any mixture thereof. The non-alkoxylated anionic surfactant can be selected from the group consisting of; $C_{10}$-$C_{20}$ primary, branched-chain, linear-chain and random-chain alkyl sulphates (AS), typically having the following formula (I):

$$CH_3(CH_2)_xCH_2—OSO_3^-M^+$$

wherein, M is hydrogen or a cation which provides charge neutrality, preferred cations are sodium and ammonium cations, wherein x is an integer of at least 7, preferably at least 9; $C_{10}$-$C_{18}$ secondary (2,3) alkyl sulphates, typically having the following formulae:

$$CH_3(CH_2)_x\overset{\overset{\displaystyle OSO_3^-M^+}{|}}{(CH)}CH_3 \quad \text{or} \quad CH_3(CH_2)_y\overset{\overset{\displaystyle OSO_3^-M^+}{|}}{(CH)}CH_2CH_3$$

wherein, M is hydrogen or a cation which provides charge neutrality, preferred cations include sodium and ammonium cations, wherein x is an integer of at least 7, preferably at least 9, y is an integer of at least 8, preferably at least 9; $C_{10}$-$C_{18}$ alkyl carboxylates; mid-chain branched alkyl sulphates as described in more detail in U.S. Pat. No. 6,020,303 and U.S. Pat. No. 6,060,443; methyl ester sulphonate (MES); alpha-olefin sulphonate (AOS); and mixtures thereof.

Another preferred anionic detersive surfactant is an alkoxylated anionic detersive surfactant. The presence of an alkoxylated anionic detersive surfactant in the spray-dried powder provides good greasy soil cleaning performance, gives a good sudsing profile, and improves the hardness tolerance of the anionic detersive surfactant system. It may be preferred for the anionic detersive surfactant to comprise from 1% to 50%, or from 5%, or from 10%, or from 15%, or from 20%, and to 45%, or to 40%, or to 35%, or to 30%, by weight of the anionic detersive surfactant system, of an alkoxylated anionic detersive surfactant.

Preferably, the alkoxylated anionic detersive surfactant is a linear or branched, substituted or unsubstituted $C_{12-18}$ alkyl alkoxylated sulphate having an average degree of alkoxylation of from 0.5 to 30, preferably from 0.5 to 10, more preferably from 0.5 to 3. Preferably, the alkoxylated anionic detersive surfactant is a linear or branched, substituted or unsubstituted $C_{12-18}$ alkyl ethoxylated sulphate having an average degree of ethoxylation of from 0.5 to 10, more preferably from 0.5 to 3. Most preferably, the alkoxylated anionic detersive surfactant is a linear unsubstituted $C_{12-18}$ alkyl ethoxylated sulphate having an average degree of ethoxylation of from 0.5 to 7, more preferably from 0.5 to 3.

The alkoxylated anionic detersive surfactant, when present with an alkyl benzene sulphonate may also increase the activity of the alkyl benzene sulphonate by making the alkyl benzene sulphonate less likely to precipitate out of solution in the presence of free calcium cations. Preferably, the weight ratio of the alkyl benzene sulphonate to the alkoxylated anionic detersive surfactant is in the range of from 1:1 to less than 5:1, or to less than 3:1, or to less than 1.7:1, or even less than 1.5:1. This ratio gives optimal whiteness maintenance performance combined with a good hardness tolerance profile and a good sudsing profile. However, it may be preferred that the weight ratio of the alkyl benzene sulphonate to the alkoxylated anionic detersive surfactant is greater than 5:1, or greater than 6:1, or greater than 7:1, or even greater than 10:1. This ratio gives optimal greasy soil cleaning performance combined with a good hardness tolerance profile, and a good sudsing profile.

Suitable alkoxylated anionic detersive surfactants are: Texapan LEST™ by Cognis; Cosmacol AES™ by Sasol; BES151™ by Stephan; Empicol ESC70/U™; and mixtures thereof.

Preferably, the anionic detersive surfactant comprises from 0% to 10%, preferably to 8%, or to 6%, or to 4%, or to 2%, or even to 1%, by weight of the anionic detersive surfactant, of unsaturated anionic detersive surfactants such as alpha-olefin sulphonate. Preferably the anionic detersive surfactant is essentially free of unsaturated anionic detersive surfactants such as alpha-olefin sulphonate. By "essentially free of" it is typically meant "comprises no deliberately added". Without wishing to be bound by theory, it is believed that these levels of unsaturated anionic detersive surfactants such as alpha-olefin sulphonate ensure that the anionic detersive surfactant is bleach compatible.

Preferably, the anionic detersive surfactant comprises from 0% to 10%, preferably to 8%, or to 6%, or to 4%, or to 2%, or even to 1%, by weight of alkyl sulphate. Preferably the anionic detersive surfactant is essentially free of alkyl sulphate. Without wishing to be bound by theory, it is believed that these levels of alkyl sulphate ensure that the anionic detersive surfactant is hardness tolerant.

Suitable non-ionic detersive surfactant can be selected from the group of: $C_8$-$C_{18}$ alkyl ethoxylates, such as, NEODOL® non-ionic surfactants from Shell; $C_6$-$C_{12}$ alkyl phenol alkoxylates wherein the alkoxylate units are ethyleneoxy units, propyleneoxy units or a mixture thereof; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols, BA, as described in more detail in U.S. Pat. No. 6,150,322; $C_{14}$-$C_{22}$ mid-chain branched alkyl alkoxylates, BAEx, wherein x=from 1 to 30, as described in more detail in U.S. Pat. No. 6,153,577, U.S. Pat. No. 6,020,303 and U.S. Pat. No. 6,093,856; alkylpolysaccharides as described in more detail in U.S. Pat. No. 4,565,647, specifically alkylpolyglycosides as described in more detail in U.S. Pat. No. 4,483,780 and U.S. Pat. No. 4,483,779; polyhydroxy fatty acid amides as described in more detail in U.S. Pat. No. 5,332,528, WO 92/06162, WO 93/19146, WO 93/19038, and WO 94/09099; ether capped poly(oxyalkylated) alcohol surfactants as described in more detail in U.S. Pat. No. 6,482,994 and WO 01/42408; and mixtures thereof.

The non-ionic detersive surfactant could be an alkyl polyglucoside and/or an alkyl alkoxylated alcohol. Preferably the non-ionic detersive surfactant is a linear or branched, substituted or unsubstituted $C_{8-18}$ alkyl ethoxylated alcohol having an average degree of ethoxylation of from 1 to 10, more preferably from 3 to 7.

Alkalinity Source

Any suitable alkalinity source is of use in the aqueous slurry. Suitable alkalinity sources include, but are not limited to being selected from the group of: carbonate salt; silicate salt; sodium hydroxide; and mixtures thereof. Exemplary alkalinity sources may be selected from the group of: sodium carbonate; sodium silicate; and mixtures thereof.

Additional Detergent Ingredients

The additional detergent ingredient may include a builder. Any suitable builder may be of use in the aqueous slurry. Suitable builders include, but are not limited to those selected from the group of: zeolite builder; phosphate builder; and mixtures thereof. Non-limiting examples of useful zeolite builders include: zeolite A; zeolite X; zeolite P; zeolite MAP; and combinations thereof. Sodium tripolyphosphate is a non-limiting example of a useful phosphate builder. The zeolite builder(s) may be present at from about 1 to about 20% by weight of the detergent composition. It may also be especially preferred for the granular detergent composition to comprise low levels, or even be essentially free, of builder. By essentially free of it is typically meant herein to mean: "comprises no deliberately added". In a preferred embodiment, the granular detergent composition is essentially free of zeolite, preferably has no zeolite. In a preferred embodiment, the granular detergent composition is essentially free of phosphate, preferably has no phosphate.

The additional detergent ingredient may include a polymer. Any suitable polymer may be of use in the aqueous slurry. Suitable polymers include, but are not limited to: polymeric carboxylate; polyester soil release agent; cellulosic polymer; and mixtures thereof. One preferred polymeric material is a polymeric carboxylate, such as a copolymer of maleic acid and acrylic acid. However, other polymers may also be suitable, such as polyamines (including the ethoxylated variants thereof), polyethylene glycol and polyesters. Polymeric soil suspending aids and polymeric soil release agents are also particularly suitable.

Another suitable polymer is cellulosic polymer, such as cellulosic polymer selected from the group of: alkyl alkoxy cellulose, preferably methyl hydroxyethyl cellulose (MHEC); alkyl cellulose, preferably methyl cellulose (MC); carboxy alkyl cellulose, preferably carboxymethylcellulose (CMC); and mixtures thereof.

Polymers may be present at from about 0.5 to about 20% or from about 1 to about 10% by weight of the detergent composition.

Other suitable detergent ingredients may be selected from the group of: chelants such as ethylene diamine disuccinic acid (EDDS); hydroxyethylene diphosphonic acid (HEDP); starch; sodium sulphate; carboxylic acids such as citric acid or salts thereof such as citrate; suds suppressor; fluorescent whitening agent; hueing agent; flocculating agent such as polyethylene oxide; and mixtures thereof. If the present detergent comprises masking agents and/or whiteners (e.g. Titanium dioxide), they may be present at less than about 1 wt % or less.

Emulsion

The emulsion comprises a polymer. Preferably, the polymer is water-soluble. Suitable polymers can be selected from, but are not limited to, the group comprising carboxylate polymers, polyethylene glycol polymers, polyester soil release polymers, amine polymers, cellulosic polymers, dye polymers, dye transfer inhibition polymers, dye lock polymers, hexamethylenediamine derivative polymers, and any combination thereof.

Suitable carboxylate polymers include maleate/acrylate random copolymer or polyacrylate homopolymer. The carboxylate polymer may be a polyacrylate homopolymer having a molecular weight of from 4,000 Da to 9,000 Da, or from 6,000 Da to 9,000 Da. Other suitable carboxylate polymers are co-polymers of maleic acid and acrylic acid, and may have a molecular weight in the range of from 4,000 Da to 90,000 Da.

Other suitable carboxylate polymers are co-polymers comprising: (i) from 50 to less than 98 wt % structural units derived from one or more monomers comprising carboxyl groups; (ii) from 1 to less than 49 wt % structural units derived from one or more monomers comprising sulfonate moieties; and (iii) from 1 to 49 wt % structural units derived from one or more types of monomers selected from ether bond-containing monomers represented by formulas (I) and (II):

formula (I)

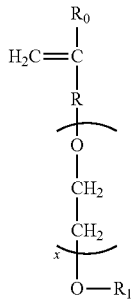

wherein in formula (I), $R_0$ represents a hydrogen atom or $CH_3$ group, R represents a $CH_2$ group, $CH_2CH_2$ group or single bond, X represents a number 0-5 provided X represents a number 1-5 when R is a single bond, and $R_1$ is a hydrogen atom or $C_1$ to $C_{20}$ organic group;

formula (II)

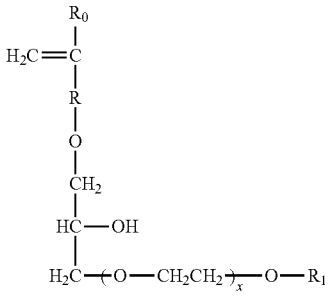

in formula (II), $R_0$ represents a hydrogen atom or $CH_3$ group, R represents a $CH_2$ group, $CH_2CH_2$ group or single bond, X represents a number 0-5, and $R_1$ is a hydrogen atom or $C_1$ to $C_{20}$ organic group.

Suitable polyethylene glycol polymers include random graft co-polymers comprising: (i) hydrophilic backbone comprising polyethylene glycol; and (ii) hydrophobic side chain(s) selected from the group consisting of: $C_4$-$C_{25}$ alkyl group, polypropylene, polybutylene, vinyl ester of a saturated $C_1$-$C_6$ mono-carboxylic acid, $C_1$-$C_6$ alkyl ester of acrylic or methacrylic acid, and mixtures thereof. Suitable polyethylene glycol polymers have a polyethylene glycol backbone with random grafted polyvinyl acetate side chains. The average molecular weight of the polyethylene glycol backbone can be in the range of from 2,000 Da to 20,000 Da, or from 4,000 Da to 8,000 Da. The molecular weight ratio of the polyethylene glycol backbone to the polyvinyl acetate side chains can be in the range of from 1:1 to 1:5, or from 1:1.2 to 1:2. The average number of graft sites per ethylene oxide units can be less than 1, or less than 0.8, the average number of graft sites per ethylene oxide units can be in the range of from 0.5 to 0.9, or the average number of graft sites per ethylene oxide units can be in the range of from 0.1 to 0.5, or from 0.2 to 0.4.

Preferably, the graft co-polymer is an amphiphilic graft co-polymer (AGP). Preferably it has a viscosity of up to 4 Pa·s at 55° C., or even up to 3 Pa·s. The viscosity is typically measured using a rheometer at a shear of 100 $s^{-1}$ and a temperature of 70° C. Those skilled in the art will recognize suitable apparatus in order to measure the viscosity. An exemplary method is to measure the viscosity at a shear rate of 100 $s^{-1}$ at temperature of 70° C., using a TA AR 2000ex, controlled stress rheometer, using a TA Instruments Peltier Concentric Cylinder Conical DIN System, hard anodized Aluminium cup and rotor, having a rotor radius of 14 mm, a rotor height of 42 mm, a cup radius of 15 mm, and a sample volume of 19.6 ml.

AGP(s) of use in the present invention are obtainable by grafting a polyalkylene oxide of number average molecular weight from about 2,000 to about 100,000 with vinyl acetate, which may be partially saponified, in a weight ratio of polyalkylene oxide to vinyl acetate of about 1:0.2 to about 1:10. The vinyl acetate may, for example, be saponified to an extent of up to 15%. The polyalkylene oxide may contain units of ethylene oxide, propylene oxide and/or butylene oxide. Selected embodiments comprise ethylene oxide.

In some embodiments the polyalkylene oxide has a number average molecular weight of from about 4,000 to about 50,000, and the weight ratio of polyalkylene oxide to vinyl acetate is from about 1:0.5 to about 1:6. A material within this definition, based on polyethylene oxide of molecular weight 6,000 (equivalent to 136 ethylene oxide units), containing approximately 3 parts by weight of vinyl acetate units per 1 part by weight of polyethylene oxide, and having itself a molecular weight of about 24,000, is commercially available from BASF as Sokalan™ HP22. HP22 is a preferred AGP as it provides improved grease stain removal from fabrics during the wash. Selected embodiments of the AGP(s) of use in the present invention as well as methods of making them are described in detail in PCT Patent Application No. WO 2007/138054. They may be present in the granular detergent compositions of the present invention at weight percentages from about 0 to about 5%, from about 0% to about 4%, or from about 0.5% to about 2%. In some embodiments, the AGP(s) is present at greater than about 1.5%. The AGP(s) are found to provide excellent hydrophobic soil suspension even in the presence of cationic coacervating polymers.

The AGP(s) are based on water-soluble polyalkylene oxides as a graft base and side chains formed by polymerization of a vinyl ester component. These polymers having an average of less than or equal to one graft site per 50 alkylene oxide units and mean molar masses ($M_w$) of from about 3000 to about 100,000.

Suitable polyester soil release polymers have a structure as defined by one of the following structures (I), (II) or (III):

$$—[(OCHR^1—CHR^2)_a—O—OC—Ar—CO-]_d \quad (I)$$

$$—[(OCHR^3—CHR^4)_b—O—OC\text{-}sAr—CO-]_e \quad (II)$$

$$—[(OCHR^5—CHR^6)_c—OR^7]_f \quad (III)$$

wherein:

a, b and c are from 1 to 200;

d, e and f are from 1 to 50;

Ar is a 1,4-substituted phenylene;

sAr is 1,3-substituted phenylene substituted in position 5 with $SO_3Me$;

Me is H, Na, Li, K, Mg/2, Ca/2, Al/3, ammonium, mono-, di-, tri-, or tetraalkylammonium wherein the alkyl groups are $C_1$-$C_{18}$ alkyl or $C_2$-$C_{10}$ hydroxyalkyl, or any mixture thereof;

$R^1$, $R^2$, $R^3$, $R^4$, $R^5$ and $R^6$ are independently selected from H or $C_1$-$C_{18}$ n- or iso-alkyl; and $R^7$ is a linear or branched $C_1$-$C_{18}$ alkyl, or a linear or branched $C_2$-$C_{30}$ alkenyl, or a cycloalkyl group with 5 to 9 carbon atoms, or a $C_8$-$C_{30}$ aryl group, or a $C_6$-$C_{30}$ arylalkyl group. Suitable polyester soil release polymers are terephthalate polymers having the structure of formula (I) or (II) above.

Suitable polyester soil release polymers include the Repel-o-tex series of polymers such as Repel-o-tex SF2 (Rhodia) and/or the Texcare series of polymers such as Texcare SRA300 (Clariant).

Suitable amine polymers include polyethylene imine polymers, such as alkoxylated polyalkyleneimines, optionally comprising a polyethylene and/or polypropylene oxide block.

The composition can comprise cellulosic polymers, such as polymers selected from alkyl cellulose, alkyl alkoxyalkyl cellulose, carboxyalkyl cellulose, alkyl carboxyalkyl, and any combination thereof. Suitable cellulosic polymers are selected from carboxymethyl cellulose, methyl cellulose, methyl hydroxyethyl cellulose, methyl carboxymethyl cellulose, and mixtures thereof. The carboxymethyl cellulose can have a degree of carboxymethyl substitution from 0.5 to 0.9 and a molecular weight from 100,000 Da to 300,000 Da. Another suitable cellulosic polymer is hydrophobically modified carboxymethyl cellulose, such as Finnfix SH-1 (CP Kelco).

Other suitable cellulosic polymers may have a degree of substitution (DS) of from 0.01 to 0.99 and a degree of blockiness (DB) such that either DS+DB is of at least 1.00 or $DB+2DS-DS^2$ is at least 1.20. The substituted cellulosic polymer can have a degree of substitution (DS) of at least 0.55. The substituted cellulosic polymer can have a degree of blockiness (DB) of at least 0.35. The substituted cellulosic polymer can have a DS+DB, of from 1.05 to 2.00. A suitable substituted cellulosic polymer is carboxymethylcellulose.

Another suitable cellulosic polymer is cationically modified hydroxyethyl cellulose.

Suitable dye transfer inhibitor (DTI) polymers include polyamine N-oxide polymers, copolymers of N-vinylpyrrolidone and N-vinylimidazole, polyvinylpyrrolidone polymers, polyvinyloxazolidones and polyvinylimidazoles or mixtures thereof. The DTI polymers discussed above are well known in the art and commercially available, for example PVP-K15 and K30 (Ashland), Sokalan HP165, HP50, HP53, HP59, HP56K, HP56, HP66 (BASF), Chromabond S-400, 5403E and S-100 (Ashland), and Polyquart FDI (Cognis).

Suitable polymers include hexamethylenediamine derivative polymers, typically having the formula:

$$R_2(CH_3)N^+(CH_2)6N^+(CH_3)R_2.2X^-$$

wherein $X^-$ is a suitable counter-ion, for example chloride, and R is a poly(ethylene glycol) chain having an average degree of ethoxylation of from 20 to 30. Optionally, the poly(ethylene glycol) chains may be independently capped with sulphate and/or sulphonate groups, typically with the charge being balanced by reducing the number of $X^-$ counter-ions, or (in cases where the average degree of sulphation per molecule is greater than two), introduction of $Y^+$ counter-ions, for example sodium cations.

Preferred polymer dyes include dye polymers, wherein a dye group is bound to a polymeric group, optionally via a linking group. Suitable polymeric groups include (1) alkoxylated polyethyleneimine (for example as disclosed in WO2012119859), (2) polyvinyl alcohol (for example as disclosed in WO2012130492), or (3) diamine derivative of an alkylene oxide capped polyethylene glycol (for example as disclosed in WO2012126665, especially FIG. 24), or polyalkoxylated alcohol, for example as described in WO2011/011799, WO2012/054058, WO2012/166699 or WO2012/166768. One preferred class of dye polymers is obtainable by reacting a blue or violet dye containing an NH2 group with a polymer to form a covalent bond via the reacted NH2 group of the blue or violet dye and the dye polymer has an average of from 0 to 30, preferably 2 to 20, most preferably 2 to 15 repeating same units. In a preferred embodiment the monomeric units are selected from alkylene oxides, preferably ethylene oxides. Typically dye polymers will be in the form of a mixture of dye polymers in which there is a mixture of molecules having a distribution of number of monomer groups in the polymer chains, such as the mixture directly produced by the appropriate organic synthesis route, for example in the case of alkylene oxide polymers, the result of an alkoxylation reaction. Such dye polymers are typically blue or violet in colour, to give to the cloth a hue angle of 230 to 345, more preferably 250 to 330, most preferably 270 to 300. In the synthesis of dye polymers unbound blue or violet organic dyes may be present in a mixture with the final dye-polymer product. The chromophore of the blue or violet dye is preferably selected from the group consisting of: azo; anthraquinone; phthalocyanine; triphendioxazine; and, triphenylmethane. In one aspect the dye polymer is obtainable by reacting a dye containing an NH[2] group with a polymer or suitable monomer that forms a polymer in situ. Preferably the NH[2] is covalently bound to an aromatic ring of the dye. Unbound dye is formed when the dye does not react with polymer. Preferred dyes containing —NH[2] groups for such reactions are selected from: acid violet 1; acid violet 3; acid violet 6; acid violet 1 1; acid violet 13; acid violet 14; acid violet 19; acid violet 20; acid violet 36; acid violet 36:1; acid violet 41; acid violet 42; acid violet 43; acid violet 50; acid violet 51; acid violet 63; acid violet 48; acid blue 25; acid blue 40; acid blue 40:1; acid blue 41; acid blue 45; acid blue 47; acid blue 49; acid blue 51; acid blue 53; acid blue 56; acid blue 61; acid blue 61:1; acid blue 62; acid blue 69; acid blue 78; acid blue 81:1; acid blue 92; acid blue 96; acid blue 108; acid blue 1 1 1; acid blue 215; acid blue 230; acid blue 277; acid blue 344; acid blue 1 17; acid blue 124; acid blue 129; acid blue 129:1; acid blue 138; acid blue 145; direct violet 99; direct violet 5; direct violet 72; direct violet 16; direct violet 78; direct violet 77; direct violet 83; food black 2; direct blue 33; direct blue 41; direct blue 22; direct blue 71; direct blue 72; direct blue 74; direct blue 75; direct blue 82; direct blue 96; direct blue 1 10; direct blue 1 1 1; direct blue 120; direct blue 120:1; direct blue 121; direct blue 122; direct blue 123; direct blue 124; direct blue 126; direct blue 127; direct blue 128; direct blue 129; direct blue 130; direct blue 132; direct blue 133; direct blue 135; direct blue 138; direct blue 140; direct blue 145; direct blue 148; direct blue 149; direct blue 159; direct blue 162; direct blue 163; food black 2; food black 1 wherein the acid amide group is replaced by NH[2]; Basic Violet 2; Basic Violet 5; Basic Violet 12; Basic Violet 14; Basic Violet 8; Basic Blue 12; Basic Blue 16; Basic Blue 17; Basic Blue 47; Basic Blue 99; disperse blue 1; disperse blue 5; disperse blue 6; disperse blue 9; disperse blue 1 1; disperse blue 19; disperse blue 20; disperse blue 28; disperse blue 40; disperse blue 56; disperse blue 60; disperse blue 81; disperse blue 83; disperse blue 87; disperse blue 104; disperse blue 1 18; disperse violet 1; disperse violet 4, disperse violet 8, disperse violet 17, disperse violet 26; disperse violet 28; solvent violet 26; solvent blue 12; solvent blue 13; solvent blue 18; solvent blue 68. Further preferred dyes are selected from mono-azo dyes which contain a phenyl group directly attached to the azo group, wherein the phenyl group has an NH[2] groups covalent bound to it. For example a mono-azo thiophene dye. The polymer chain may be selected from polyalkylene oxides. The polymer chain and/or the dye chromophore group may optionally carry anionic or cationic groups. Examples of polyoxyalkylene oxide chains include ethylene oxide, propylene oxide, glycidol oxide, butylene oxide and mixtures thereof.

Suitable polymeric dyes include polymeric dyes selected from the group consisting of polymers containing covalently bound (sometimes referred to as conjugated) chromogens, (dye-polymer conjugates), for example polymers with chromogens co-polymerized into the backbone of the polymer and mixtures thereof. Polymeric dyes include those described in WO2011/98355, US 2012/225803 A1, US 2012/090102 A1, U.S. Pat. No. 7,686,892 B2, and WO2010/142503.

In another aspect, suitable polymeric dyes include polymeric dyes selected from the group consisting of fabric-substantive colorants sold under the name of Liquitint® (Milliken, Spartanburg, S.C., USA), dye-polymer conjugates formed from at least one reactive dye and a polymer selected from the group consisting of polymers comprising a moiety selected from the group consisting of a hydroxyl moiety, a primary amine moiety, a secondary amine moiety, a thiol moiety and mixtures thereof. In still another aspect, suitable polymeric dyes include polymeric dyes selected from the group consisting of Liquitint® Violet CT, carboxymethyl cellulose (CMC) covalently bound to a reactive blue, reactive violet or reactive red dye such as CMC conjugated with C.I. Reactive Blue 19, sold by Megazyme, Wicklow, Ireland under the product name AZO-CM-CELLULOSE, product code S-ACMC, alkoxylated triphenylmethane polymeric colourants, alkoxylated thiophene polymeric colourants, and mixtures thereof.

Preferably, the polymer is present as the discrete phase, however it may alternatively be the continuous phase. Preferrably, the polymer is the discrete phase and the continuous phase is a suitable solvent. For example, water or a surfactant or a mixture thereof.

The surfactant can be selected from non-ionic, cationic, anionic, zwitterionic surfactants and mixtures thereof. The surfactant may be a non-ionic surfactant, an anionic surfactant or a mixture thereof. The surfactant may be a non-ionic surfactant, or even an alkoxylated non-ionic surfactant. Preferably, the surfactant is anhydrous. This has the benefit of limiting the amount of water that is transferred onto the spray-dried detergent particles. It is most preferred to use a non-ionic anhydrous surfactant as this as a lower viscosity as compared to other anhydrous surfactants. This lower viscosity aids both the emulsification and the process of spraying onto the spray-dried detergent particles. Without being bound by theory, if the viscosity of the continuous phase of the emulsion is too high, then the energy input required to achieve the emulsion will be very high. This is cost and energy inefficient. Furthermore, if the surfactant viscosity is too high, this can cause blockages of nozzles etc during the making process and higher levels of undesirable oversized particles.

The non-ionic surfactant for use in the emulsion could be an alkyl polyglucoside and/or an alkyl alkoxylated alcohol. Preferably the non-ionic surfactant is a linear or branched, substituted or unsubstituted $C_{8-18}$ alkyl ethoxylated alcohol having an average degree of ethoxylation of from 1 to 10, more preferably from 3 to 7.

Suitable non-ionic surfactants include alkyl polyglucoside and/or an alkyl alkoxylated alcohol. Preferred non-ionic alkyl alkoxylated alcohols include $C_{8-18}$ alkyl alkoxylated alcohol, preferably a $C_{8-18}$ alkyl ethoxylated alcohol, preferably the alkyl alkoxylated alcohol has an average degree of alkoxylation of from 1 to 50, preferably from 1 to 30, or from 1 to 20, or from 1 to 10, preferably the alkyl alkoxylated alcohol is a $C_{8-18}$ alkyl ethoxylated alcohol having an average degree of ethoxylation of from 1 to 10, preferably from 1 to 7, more preferably from 1 to 5 and most preferably from 3 to 7. The alkyl alkoxylated alcohol can be linear or branched, and substituted or un-substituted. Suitable non-ionic surfactants can be selected from the group consisting of: $C_8$-$C_{18}$ alkyl ethoxylates, such as, NEODOL® non-ionic surfactants from Shell; $C_6$-$C_{12}$ alkyl phenol alkoxylates wherein preferably the alkoxylate units are ethyleneoxy units, propyleneoxy units or a mixture thereof; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols; $C_{14}$-$C_{22}$ mid-chain branched alkyl alkoxylates, preferably having an average degree of alkoxylation of from 1 to 30; alkylpolysaccharides, preferably alkylpolyglycosides; polyhydroxy fatty acid amides; ether capped poly(oxyalkylated) alcohol surfactants; and mixtures thereof.

Suitable non-ionic surfactants for use in the emulsion can be selected from the group of: $C_8$-$C_{18}$ alkyl ethoxylates, such as, NEODOL® non-ionic surfactants from Shell; $C_6$-$C_{12}$ alkyl phenol alkoxylates wherein the alkoxylate units are ethyleneoxy units, propyleneoxy units or a mixture thereof; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols, BA, as described in more detail in U.S. Pat. No. 6,150,322; $C_{14}$-$C_{22}$ mid-chain branched alkyl alkoxylates, BAEx, wherein x=from 1 to 30, as described in more detail in U.S. Pat. No. 6,153,577, U.S. Pat. No. 6,020,303 and U.S. Pat. No. 6,093,856; alkylpolysaccharides as described in more detail in U.S. Pat. No. 4,565,647, specifically alkylpolyglycosides as described in more detail in U.S. Pat. No. 4,483,780 and U.S. Pat. No. 4,483,779; polyhydroxy fatty acid amides as described in more detail in U.S. Pat. No. 5,332,528, WO 92/06162, WO 93/19146, WO 93/19038, and WO 94/09099; ether capped poly(oxyalkylated) alcohol surfactants as described in more detail in U.S. Pat. No. 6,482,994 and WO 01/42408; and mixtures thereof.

Anionic surfactants can include sulphate and sulphonate surfactants. Preferred sulphonate surfactants include alkyl benzene sulphonate, preferably $C_{10-13}$ alkyl benzene sulphonate. Suitable alkyl benzene sulphonate (LAS) is obtainable, preferably obtained, by sulphonating commercially available linear alkyl benzene (LAB); suitable LAB includes low 2-phenyl LAB, such as those supplied by Sasol under the tradename Isochem® or those supplied by Petresa under the tradename Petrelab®, other suitable LAB include high 2-phenyl LAB, such as those supplied by Sasol under the tradename Hyblene®. A suitable anionic surfactant is alkyl benzene sulphonate that is obtained by DETAL catalyzed process, although other synthesis routes, such as HF, may also be suitable. Preferred sulphate surfactants include alkyl sulphate, preferably $C_{8-18}$ alkyl sulphate, or predominantly $C_{12}$ alkyl sulphate. Another preferred sulphate surfactant is alkyl alkoxylated sulphate, preferably alkyl ethoxylated sulphate, preferably a $C_{8-18}$ alkyl alkoxylated sulphate, preferably a $C_{8-18}$ alkyl ethoxylated sulphate, preferably the alkyl alkoxylated sulphate has an average degree of alkoxylation of from 0.5 to 20, preferably from 0.5 to 10, preferably the alkyl alkoxylated sulphate is a $C_{8-18}$ alkyl ethoxylated sulphate having an average degree of ethoxylation of from 0.5 to 10, preferably from 0.5 to 7, more preferably from 0.5 to 5 and most preferably from 0.5 to 3. The alkyl sulphate, alkyl alkoxylated sulphate and alkyl benzene sulphonates may be linear or branched, substituted or un-substituted.

Suitable organic anionic surfactants include alkyl aryl sulphonates, for example sodium dodecyl benzene sulphonate, long chain (fatty) alcohol sulphates, olefin sulphates and sulphonates, sulphated monoglycerides, sulphated esters, sulphonated or sulphated ethoxylate alcohols, sulphosuccinates, alkane sulphonates, alkali metal soaps of higher fatty acids, phosphate esters, alkyl isethionates, alkyl taurates and/or alkyl sarcosinates.

Suitable cationic surfactants include alkyl pyridinium compounds, alkyl quaternary ammonium compounds, alkyl quaternary phosphonium compounds, alkyl ternary sulphonium compounds, and mixtures thereof. Preferred cationic surfactants are quaternary ammonium compounds having the general formula:

$$(R)(R_1)(R_2)(R_3)N^+X^-$$

wherein, R is a linear or branched, substituted or unsubstituted $C_{6-18}$ alkyl or alkenyl moiety, $R_1$ and $R_2$ are independently selected from methyl or ethyl moieties, $R_3$ is a hydroxyl, hydroxymethyl or a hydroxyethyl moiety, X is an anion which provides charge neutrality, preferred anions include: halides, preferably chloride; sulphate; and sulphonate. Preferred cationic detersive surfactants are mono-$C_{6-18}$ alkyl mono-hydroxyethyl di-methyl quaternary ammonium chlorides. Highly preferred cationic detersive surfactants are mono-$C_{8-10}$ alkyl mono-hydroxyethyl di-methyl quaternary ammonium chloride, mono-$C_{10-12}$ alkyl mono-hydroxyethyl di-methyl quaternary ammonium chloride and mono-$C_{10}$ alkyl mono-hydroxyethyl di-methyl quaternary ammonium chloride.

A cationic surfactant can for example be an alkylamine salt, a quaternary ammonium salt, a sulphonium salt or a phosphonium salt.

A zwitterionic (amphoteric) surfactant can for example be an imidazoline compound, an alkylaminoacid salt or a betaine.

Preferably, the emulsion comprises a surfactant continuous phase and an amphiphilic graft co-polymer (AGP) discrete phase. Thus, the surfactant and the AGP are immiscible with other. Preferably, the surfactant is water-soluble and independently the AGP is water-soluble. Most preferably, the surfactant and the AGP are water-soluble.

As detailed above, this viscosity is preferred as it allows more efficient spraying of the emulsion on the spray-dried detergent particles.

The ratio of surfactant to AGP can be from 1:2 to 2:1.

The inventors have found that when certain polymers such as amphiphilic graft copolymer(s) are spray-dried with other detergent ingredients, the resulting spray-dried powder has a consumer undesirable yellow hue. The yellowing can be especially problematic in detergent matrices having high alkalinity and/or that are processed under high temperature conditions. Without wishing to be bound by theory, it is believed that the discoloration of the granules results from the occurrence of one or more chemical reactions with the AGP(s) as it is subjected to the conditions in the tower. Such reactions may include:

a. Chain degradation reaction through oxidation may occur at the level of the polymer PEG backbone;
b. Dehydration of the vinyl acetate/alcohol functionalities can lead to formation of double bonds in the hydrophobic side chains;
c. Hydrolysis reactions may occur at the vinyl acetate functionalities of the hydrophobic side chains; and/or
d. Residuals (monomer residue) may form acetaldehyde & acetate.

It was surprisingly found that addition of AGPs to spray-dried powders using the process of the present invention result in the spray-dried detergent particles having a reduced yellow hue as compared to spray-dried particles in which the AGP had been incorporated using a different method.

Optical Brightener

Preferred classes of optical brightener are: Di-styryl biphenyl compounds, e.g. Tinopal™ CBS-X, Di-amino stilbene di-sulfonic acid compounds, e.g. Tinopal™ DMS pure Xtra and Blankophor™ HRH, and Pyrazoline compounds, e.g. Blankophor™ SN. Preferred brighteners are: sodium 2 (4-styryl-3-sulfophenyl)-2H-napthol[1,2-d]triazole, disodium 4,4'-bis{[4-anilino-6-(N methyl-N-2 hydroxyethyl) amino 1,3,5-triazin-2-yl)]; amino}stilbene-2-2' disulfonate, disodium 4,4'-bis{[(4-anilino-6-morpholino-1,3,5-triazin-2-yl)]amino} stilbene-2-2' disulfonate, and disodium 4,4'-bis (2-sulfostyryl)biphenyl, or mixtures thereof.

A particularly preferred optical brightener is C.I. Fluorescent Brightener 260 having the following structure. For solid detergent compositions, this optical brightener may be used in its beta or alpha crystalline forms, or a mixture of these forms.

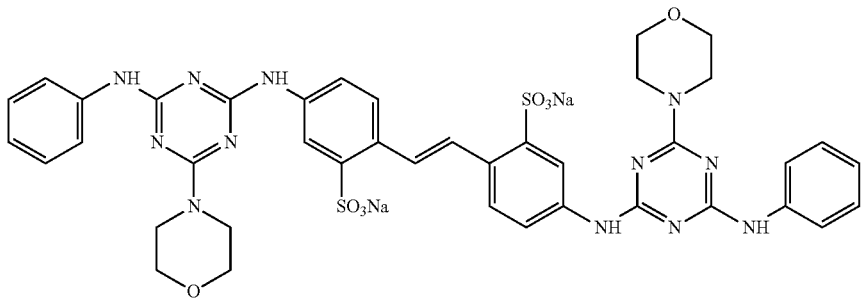

The optical brightener of the present invention may comprise any of the optical brighteners detailed in this description or any mixtures thereof.

The Granular Detergent Composition

The granular detergent composition is suitable for any laundry detergent application, for example: laundry, including automatic washing machine laundering and hand laundering, and even bleach and laundry additives.

The granular detergent composition can be a fully formulated detergent product, such as a fully formulated laundry detergent product, or it can be combined with other particles to form a fully formulated detergent product, such as a fully formulated laundry detergent product. The granular detergent composition may be combined with other particles such as: enzyme particles; perfume particles including agglomerates or extrudates of perfume microcapsules, and perfume encapsulates such as starch encapsulated perfume accord particles; surfactant particles, such as non-ionic detersive surfactant particles including agglomerates or extrudates, anionic detersive surfactant particles including agglomerates and extrudates, and cationic detersive surfactant particles including agglomerates and extrudates; polymer particles including soil release polymer particles, cellulosic polymer particles; buffer particles including carbonate salt and/or silicate salt particles, preferably a particle comprising carbonate salt and silicate salt such as a sodium carbonate and sodium silicate co-particle, and particles and sodium bicarbonate; other spray-dried particles; fluorescent whitening particles; aesthetic particles such as coloured noodles or needles or lamellae particles; bleaching particles such as percarbonate particles, especially coated percarbonate particles, including carbonate and/or sulphate coated percarbonate, silicate coated percarbonate, borosilicate coated percarbonate, sodium perborate coated percarbonate; bleach catalyst particles, such as transition metal catalyst bleach particles, and imine bleach boosting particles; performed peracid particles; hueing dye particles; and any mixture thereof.

It may also be especially preferred for the granular detergent composition to comprise low levels, or even be essentially free, of builder. By essentially free of it is typically meant herein to mean: "comprises no deliberately added". In a preferred embodiment, the granular detergent composition comprises no builder.

The whiteness of the granular detergent composition can be measured using a HunterLab Color difference meter and following appropriate operating procedure. Various models of the HunterLab Color difference meter can be used, such as the HunterLab LabScan XE or HunterLab Model D25. Care is taken to make sure that the powder sample is free of lumps and is representative of the overall particle size. The readings are taken at ambient temperature.

A HunterLab color difference meter is used to characterize color of a sample into three different parameters according to the Hunter L, a, b color scale. In this scale, the differences between points plotted in a color space correspond to visual differences between the colors plotted. The Hunter L, a, b color scale is organized in cube form. The L axis of the cube runs from top to bottom. The maximum for L is 100, which would be a perfect reflecting diffuser. The minimum for L would be zero, which would be black. The a and b axes of the cube have no specific numerical limits. Positive a is red. Negative a is green. Positive b is yellow. Negative b is blue.

The "L-3b" (L minus 3b) value signifies the whiteness of the sample. The whiteness of a blown powder according to the present invention is at least about 73.5.

The granular detergent composition according to the present invention may have a bulk density of from about 250 to about 550 grams per liter, or from about 300 to about 450 grams per liter.

The granular detergent composition may have a mean particle granule size of from about 300 to about 550 microns, or from about 350 to about 450 microns.

EXAMPLES

A comparison was made between a granular laundry detergent composition according to the present invention and a granular laundry detergent composition outside of the scope of the present claims.

An aqueous alkaline slurry composed of sodium sulphate, sodium carbonate, water, acrylate/maleate co-polymer and miscellaneous ingredients was prepared at 80° C. in a crutcher making vessel. The aqueous slurry was essentially free from zeolite builder and essentially free from phosphate builder. Alkyl benzene sulphonic acid (HLAS) and sodium hydroxide were added to the aqueous slurry and the slurry was pumped through a standard spray system pressure nozzle and atomized into a counter current spray drying tower at an air inlet temperature of 275° C. The atomized slurry was dried to produce a solid mixture, which was then cooled and sieved to remove oversize material (>1.8 mm) to form a spray-dried powder. The spray-dried powder had a bulk density of 470 g/l.

The composition of the spray-dried powder is given Table 1.

TABLE 1

| Component | % w/w Spray Dried Powder |
|---|---|
| Sodium silicate salt | 10.0 |
| $C_8$-$C_{24}$ alkyl benzene sulphonate | 15.1 |

TABLE 1-continued

| Component | % w/w Spray Dried Powder |
|---|---|
| Acrylate/maleate copolymer | 4.0 |
| Hydroxyethane di(methylene phosphonic acid) | 0.7 |
| Sodium carbonate | 11.9 |
| Sodium sulphate | 53.7 |
| Water | 2.5 |
| Miscellaneous, such as magnesium sulphate, and one or more stabilizers | 2.1 |
| Total Parts | 100.00 |

TABLE 2

| Component | % w/w granular laundry detergent composition |
|---|---|
| Spray-dried powder (described above in table 1) | 59.38 |
| 91.6 wt % active linear alkyl benzene sulphonate flake supplied by Stepan under the tradename Nacconol 90G ® | 0.22 |
| Citric acid | 5.00 |
| Sodium percarbonate (having from 12% to 15% active AvOx) | 14.70 |
| Photobleach particle | 0.01 |
| Lipase (11.00 mg active/g) | 0.70 |
| Amylase (21.55 mg active/g) | 0.33 |
| Protease (56.00 mg active/g) | 0.43 |
| Tetraacetyl ethylene diamine agglomerate (92 wt % active) | 4.35 |
| Suds suppressor agglomerate (11.5 wt % active) | 0.87 |
| Acrylate/maleate copolymer particle (95.7 wt % active) | 0.29 |
| Green/Blue carbonate speckle | 0.50 |
| Sodium Sulphate | 9.63 |
| Solid perfume particle | 0.63 |
| Sokalan HP22 polymer supplied by BASF (72.5% active polymer) | 1.63 |
| Ethoxylated $C_{12}$-$C_{18}$ alcohol having an average degree of ethoxylation of 7 (AE7) | 1.33 |
| Total Parts | 100.00 |

The granular laundry detergent composition of Table 2 was prepared by dry-mixing all of the above components (all except the AE7 and Sokalan HP22 polymer) in a continuous rotary mixer (drum diameter 0.6 meters, drum length 1.8 meters, 28 revolutions per min). The total mass flow rate of the powder feeds into the continuous rotary mixer was set at 2913 kg/hr. A mixture of AE7 in liquid form and Sokalan HP22 polymer in liquid form was sprayed on is the particles as they passed through the continuous rotary mixer. The mass flow rate of the liquid mixture was set to 88.9 kg/hr according to formulation in table 2. The liquid mixture was atomized into droplets by air assisted nozzles operating at a air supply pressure of 5.2 bar gauge prior to liquid mixture addition into the continuous rotary mixer.

According to the present invention, a granular detergent composition (Granular detergent A) was prepared where the liquid mixture was first emulsified (AE7 continuous phase) by passing through a high shear dynamic mixer (IKA Dispax-Reactor®; Model Size: DR2000/Mixer Speed 4000 rpm) prior to atomizing and adding to powder.

A granular laundry detergent composition outside of the scope of the present claims (Granular detergent B) was prepared where the liquid mixture was not emulsified but blended together in a liquid batch mixture prior to atomizing and adding to powder.

1 kg representative powder samples exiting the continuous rotary mixer were taken for granular detergent A and granular detergent B and analyzed for particle size greater than 1180 and 850 microns. 10 samples are collected and the average analysis presented in Table 3.

TABLE 3

| | Wt % >1180 microns | Wt % >850 microns |
|---|---|---|
| Granular Detergent A | 15.7 | 32.6 |
| Granular Detergent B | 24.5 | 45.7 |

As can be seen from Table 3, granular detergent A has fewer undesired oversize particles compared to granular detergent B. Oversize particles are defined as particles of size 1180 microns or greater, which are perceived by consumers as being oversized. Even more preferred by consumers are particle sizes of 850 microns of less. Thus, emulsification of the AGP in surfactant results in fewer oversize particles.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process of making a granular detergent composition comprising the steps of:

a) forming an aqueous detergent slurry;

b) spray drying said aqueous detergent slurry to form a plurality of spray-dried detergent particles;

c) separately forming an emulsion comprising:

i. forming a first liquid, optionally comprising a surfactant;

ii. forming a second liquid comprising a polymer;

iii. passing the first and second liquids through a high shear mixer;

iv. mixing the first and second liquids to form the emulsion; and d) adding the emulsion from step c) to at least a portion of said plurality of spray-dried detergent particles, wherein an optical brightener is added with the polymer prior to the formation of the emulsion or an optical brightener is added to the emulsion once it is formed in step iv; and wherein said aqueous detergent slurry comprises from about 0 wt % to about 5 wt % zeolite builder and from about 0 wt % to about 5 wt % phosphate builder.

2. A process according to claim 1, wherein the polymer is selected from the group consisting of carboxylate polymers, polyethylene glycol polymers, polyester soil release polymers, amine polymers, cellulosic polymers, dye polymers, dye transfer inhibition polymers, dye lock polymers, hexamethylenediamine derivative polymers, and any combination thereof.

3. A process according to claim 1, wherein the polymer is an amphiphilic graft copolymer.

4. A process according to claim 3, wherein the amphiphilic graft copolymer comprises a graft copolymer of polyethylene, polypropylene or polybutylene oxide with vinyl acetate in a weight ratio of from about 1:0.2 to about 1:10.

5. The process according to claim 1, wherein the polymer is water-soluble.

6. The process according to claim 1, wherein the surfactant is present in the emulsion.

7. The process according to claim 6, wherein the surfactant is selected from an anionic, cationic, zwitterionic or non-ionic surfactant.

8. The process according to claim 1, wherein the aqueous detergent slurry comprises a detersive surfactant.

9. The process according to claim 1, wherein the aqueous detergent slurry comprises at least one additional detergent ingredient.

10. The process according to claim 1, wherein the aqueous detergent slurry further comprises an alkalinity source.

11. The process according to claim 1, wherein the emulsion is at a temperature of from about 30° C. to about 60° C. prior to it being added to the detergent particles.

12. The process according to claim 1, wherein the emulsion is at a temperature of between about 40° C. and about 60° C. prior to being added to the spray-dried detergent particles.

* * * * *